US011247463B2

(12) United States Patent
Shimosato

(10) Patent No.: US 11,247,463 B2
(45) Date of Patent: Feb. 15, 2022

(54) LIQUID DISCHARGE HEAD, METHOD OF MANUFACTURING LIQUID DISCHARGE HEAD, AND LIQUID DISCHARGE APPARATUS

(71) Applicant: TOSHIBA TEC KABUSHIKI KAISHA, Tokyo (JP)

(72) Inventor: Masashi Shimosato, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 93 days.

(21) Appl. No.: 16/750,905

(22) Filed: Jan. 23, 2020

(65) Prior Publication Data

US 2020/0290354 A1 Sep. 17, 2020

(30) Foreign Application Priority Data

Mar. 13, 2019 (JP) ..... JP2019-045818

(51) Int. Cl.
*B41J 2/14* (2006.01)

(52) U.S. Cl.
CPC .. *B41J 2/14201* (2013.01); *B41J 2002/14411* (2013.01)

(58) Field of Classification Search
CPC ..... B41J 2002/14411; B41J 2/14201; B41J 29/02; B41J 29/13
See application file for complete search history.

(56) References Cited

U.S. PATENT DOCUMENTS

2007/0216734 A1* 9/2007 Kitamura ..... B41J 2/14274 347/68
2010/0141711 A1* 6/2010 Koseki ..... B41J 2/14201 347/65
2018/0072058 A1 3/2018 Miyazawa

FOREIGN PATENT DOCUMENTS

EP 1834782 A2 9/2007
JP 2000-168094 A 6/2000

OTHER PUBLICATIONS

Extended European Search Report dated Jul. 13, 2020 mailed in corresponding European Patent Application No. 20157859.8, 8 pages.

* cited by examiner

*Primary Examiner* — Thinh H Nguyen
(74) *Attorney, Agent, or Firm* — Kim & Stewart LLP

(57) ABSTRACT

A liquid discharge head includes an actuator base, a case member, and a nozzle plate. The actuator base includes a plurality of grooves space from each other in a first direction. Each of the grooves extends in a second direction. The actuator base is formed of a piezoelectric ceramic material. The case member includes a frame portion spaced from the actuator base in the second direction. The frame portion has an end surface in the third direction that is level with an end surface of the actuator base in the third direction. The frame portion is formed of a ceramic material having aluminum titanate as a main component. The nozzle plate is contacting the end surface of the frame portion and the end surface of the actuator base.

20 Claims, 4 Drawing Sheets

LIQUID DISCHARGE HEAD, METHOD OF MANUFACTURING LIQUID DISCHARGE HEAD, AND LIQUID DISCHARGE APPARATUS

CROSS-REFERENCE TO RELATED APPLICATION

This application is based upon and claims the benefit of priority from Japanese Patent Application No. 2019-045818, filed on Mar. 13, 2019, the entire contents of which are incorporated herein by reference.

FIELD

Embodiments described herein relate generally to a liquid discharge head, a method of manufacturing a liquid discharge head, and a liquid discharge apparatus.

BACKGROUND

As a liquid discharge head, a shear-mode shared-wall type liquid discharge head including a plurality of pressure chambers communicating with adjacent nozzles is known. In such a liquid discharge head, for example, a groove is formed at an end of a flat actuator substrate made of piezoelectric ceramics (e.g., PZT) to form a pressure chamber, and side plates are arranged on both sides of the actuator substrate to form a space serving as a common liquid chamber. The side plates are formed of a free-cutting ceramic (Macerite, Photoveel, or the like) of which workability is close to that of a piezoelectric ceramic PZT, and the actuator substrate is then polished together with the side plates to form a bonding surface that can be bonded to a nozzle plate.

DETAILED DESCRIPTION

Figure 1:
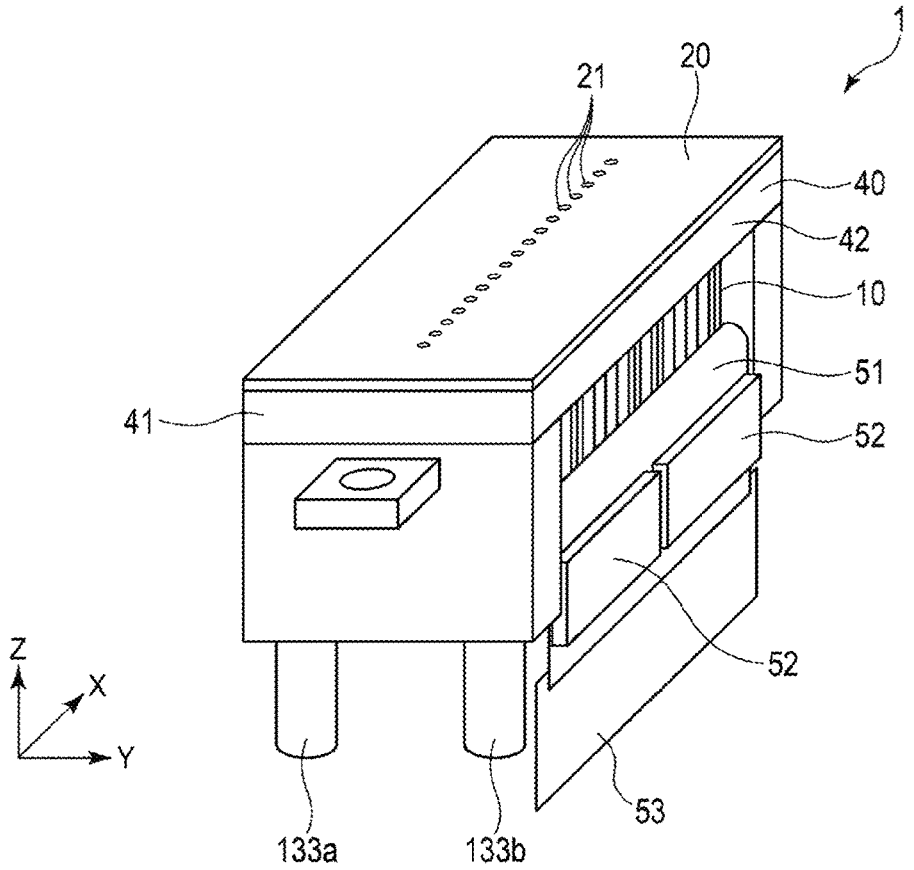
FIG. 1 illustrates a perspective view of an inkjet head according to a first embodiment.

Embodiments provide a liquid discharge head that can be easily manufactured, a method of manufacturing a liquid discharge head, and a liquid discharge apparatus.

In general, according to an embodiment, a liquid discharge head includes an actuator base, a case member, and a nozzle plate. The actuator base includes a plurality of grooves arranged in a first direction. Each of the grooves extends in a second direction crossing the first direction. The actuator base is formed of a piezoelectric ceramic material. The case member includes a frame portion spaced from the actuator base in the second direction. The frame portion having an end surface in a third direction orthogonal to the first and second direction that is level with an end surface of the actuator base in the third direction. The frame portion being formed of a ceramic material having aluminum titanate as a main component. The nozzle plate is contacting the end surface of the frame portion and the end surface of the actuator base.

Hereinafter, an inkjet head 1, which is a type of liquid discharge head, and an inkjet printer 100, which is type of a liquid discharge apparatus, will be described with reference to FIGS. 1 to 6. In each drawing, the depicted configuration or portions thereof may be enlarged, reduced or omitted as appropriate for purposes of explanation. The X-axis, Y-axis, and Z-axis in the drawings indicate three directions that are orthogonal to one another. In the described embodiment, an example in which a first direction of the inkjet head 1 is placed along an X axis, a second direction thereof is placed along a Y axis, and a third direction thereof is placed along a Z axis is depicted.

Figure 2:
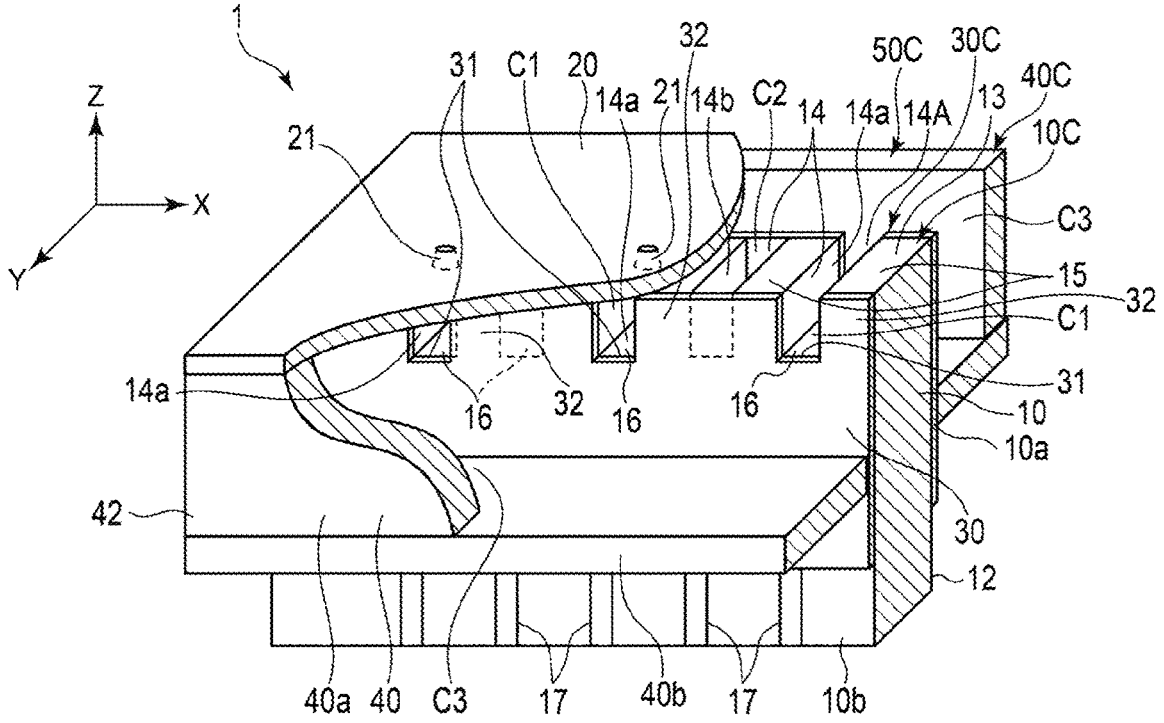
FIG. 2 illustrates a perspective view of an internal structure of the inkjet head.
Figure 3:
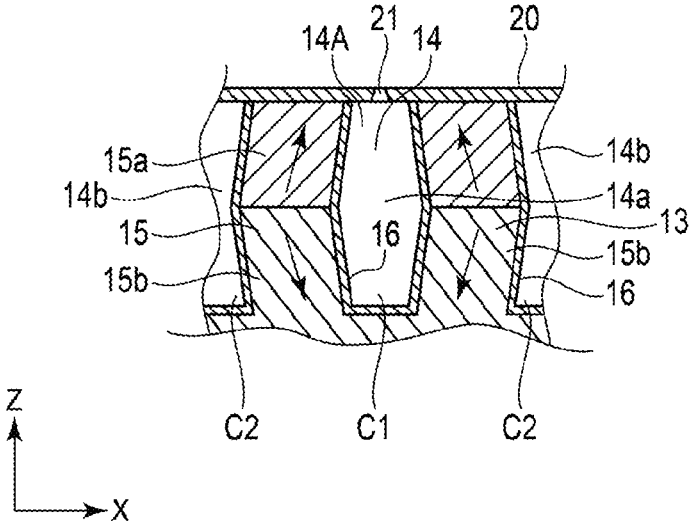
FIGS. 3 and 4 schematically illustrate a cross-sectional view of a pressure chamber to explain an operation of the inkjet head.
Figure 4:
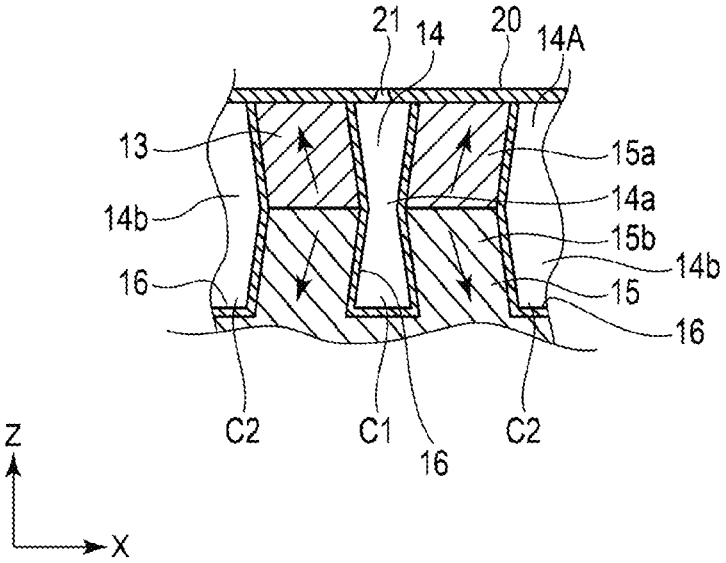
Figure 5:
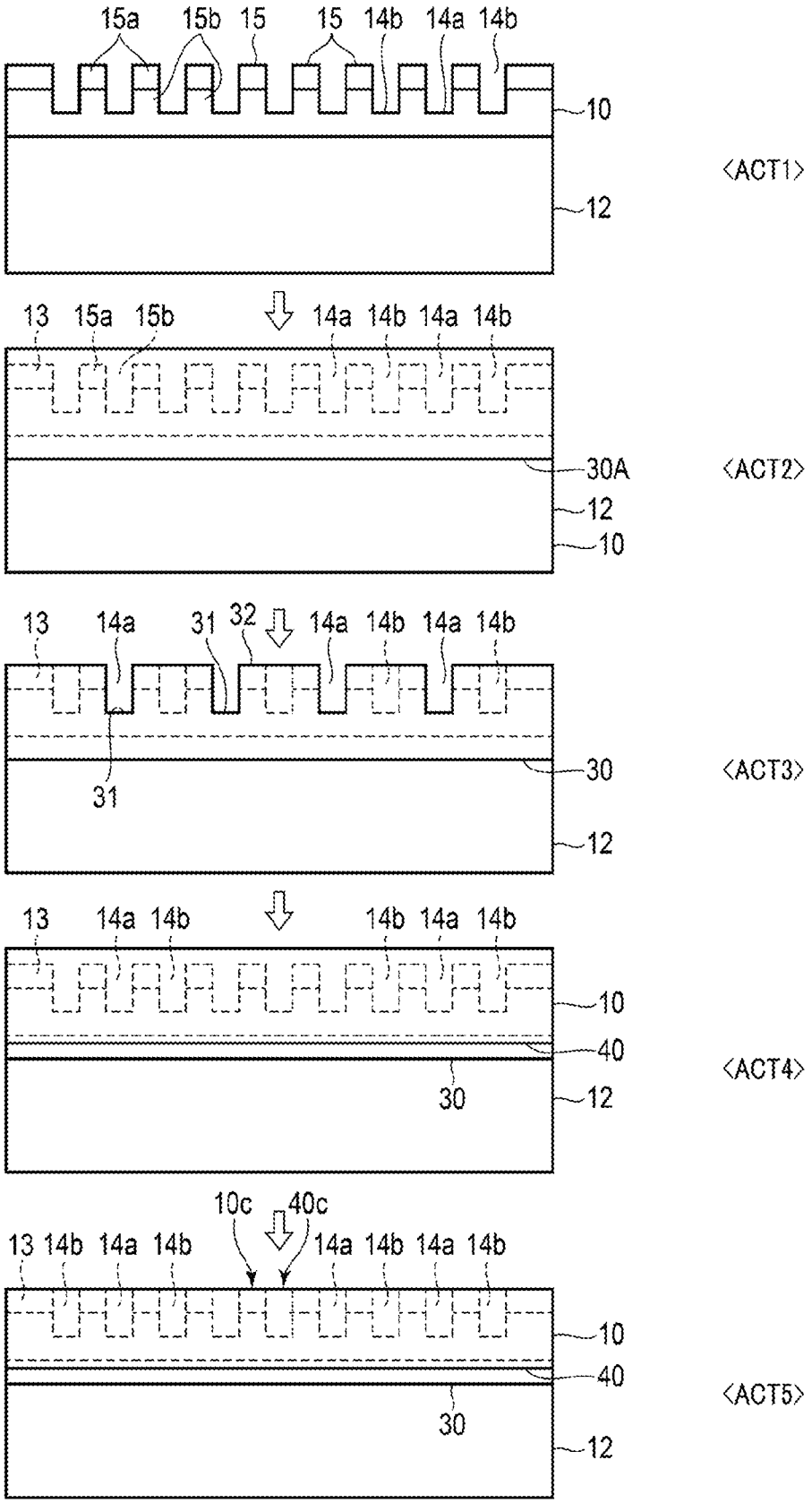
FIG. 5 illustrates a manufacturing process of the inkjet head.

FIG. 1 illustrates a perspective view of the inkjet head 1 according to the first embodiment, and FIG. 2 illustrates a perspective view of an internal structure of the inkjet head 1. FIGS. 3 and 4 illustrate operations of the inkjet head 1 and show an internal structure of a case member 40. FIG. 5 illustrates a manufacturing process of the inkjet head 1.

The inkjet head 1 shown in FIGS. 1 to 4 is a shear-mode shared-wall type inkjet head of a so-called end shooter type.

The inkjet head 1 includes an actuator base 10, a nozzle plate 20 having a plurality of nozzles 21, a cover plate 30, which is also referred to as a cover member, and a case member 40.

The actuator base 10 includes a substrate 12 and a laminated piezoelectric body 13, which is a piezoelectric section.

The substrate 12 is formed in a rectangular plate shape. The substrate 12 is preferably formed of PZT, ceramics, glass, free-cutting ceramics, or materials containing these materials.

The laminated piezoelectric body 13 is positioned at the end edge of the substrate 12 on the nozzle plate 20 side. The laminated piezoelectric body 13 is formed by laminating two piezoelectric members. The piezoelectric members are formed of, for example, a lead zirconate titanate (PZT)-based ceramic material. Additionally, as the piezoelectric member, a lead-free piezoelectric ceramic such as potassium sodium niobate (KNN) may be used in consideration of environment. The two piezoelectric members are polarized to have opposite polarization directions and bonded via an adhesive layer.

A groove row 14A including a plurality of grooves 14 aligned in a first direction is formed on an end surface of the laminated piezoelectric body 13 facing the nozzle plate 20. A shape along an XZ plane of the laminated piezoelectric body 13 is a comb teeth shape. A support-like portion formed between the grooves 14 adjacent to each other forms a laminated piezoelectric element 15 serving as a driving section that changes the volume of the grooves 14. In other words, in the laminated piezoelectric body 13, a plurality of the laminated piezoelectric elements 15 are aligned in the first direction and the groove 14 is formed between the laminated piezoelectric elements 15 adjacent to each other.

In the groove row 14A, a plurality of first grooves 14*a* forming pressure chambers C1, and a plurality of second grooves 14*b* forming air chambers C2 are alternately arranged in the first direction. The plurality of grooves 14 are arranged side by side in the first direction, extend along the second direction, and are arranged in parallel to one another. The grooves 14*a* and 14*b* are respectively formed over the entire length in the second direction of the actuator base 10. That is, the grooves 14*a* and 14*b* are open on the nozzle plate 20 side and the cover plate 30 side. On an inner bottom portion and both side surfaces of each of the grooves 14*a* and 14*b*, electrodes 16 are formed.

Both ends in the second direction of the first groove 14*a* are open on an inner side of a frame section 40*a* that is a first member to communicate with a common chamber C3. The nozzle 21 is provided at a position facing the first groove 14*a*. That is, the first groove 14*a* forms the pressure chamber C1 that communicates with the common chamber C3 and communicates with the nozzle 21.

Both end portions of the second grooves 14*b* in the second direction are covered by the cover plate 30 in the frame section 40*a*. The second groove 14*b* is closed to form the air chamber C2 separated from the common chamber C3 and the pressure chamber C1.

The laminated piezoelectric elements 15 are disposed among the plurality of grooves 14 on one end side of the actuator base 10. That is, the plurality of laminated piezoelectric elements 15 are arranged side by side in the first direction. Each laminated piezoelectric element 15 includes a first piezoelectric element 15*a*, and a second piezoelectric element 15*b* laminated on the first piezoelectric element 15*a*. One side end surface of the actuator base 10, which is the upper surface side in FIG. 1, forms a nozzle facing surface 10*c*, which is disposed so as to face the nozzle plate 20. The nozzle facing surface 10*c* forms a flat plane along an XY plane in FIG. 1. The nozzle facing surface 10*c* is polished together with the nozzle facing surfaces 30*c* and 40*c* during fabrication processing to form a flush polished surface 50*c* (see FIG. 2).

The electrode 16 is a conductive film formed of a conductive material such as nickel. The electrode 16 is formed from a bottom portion of each of the grooves 14*a* and 14*b* to an upper surface of the substrate 12 and is connected to a wiring pattern 17. The electrode 16 is formed by, for example, a method such as a vacuum deposition method or an electroless nickel plating method. For example, with an electroless plating method, a metal film can be easily formed even in the fine groove 14. In the present embodiment, the material of the electrode 16 is nickel, but is not limited to thereto.

The electrode 16 may be formed of, for example, gold or copper. Alternatively, the electrode 16 may be a laminate of two or more conductive films.

The wiring pattern 17 is, for example, a conductive film formed of a conductive material such as nickel similarly to the electrode 16 and having a predetermined pattern shape. The wiring pattern 17 is formed on a pair of principal surfaces 10*a* and 10*b* of the actuator base 10. For example, the wiring pattern 17 is formed at the same time when the electrode 16 is formed by a method such as a vacuum deposition method or an electroless plating method. The portion on the other side of the substrate 12 in the Z direction is exposed outside a frame member. Therefore, a driving circuit can be connected to the wiring pattern 17 disposed in this portion by flexible printed circuit (FPC) or the like.

For example, the nozzle plate 20 is formed of a polyimide film having a thickness of 10 μm to 100 μm into a rectangular plate shape. In the nozzle plate 20, a nozzle array which has the plurality of nozzles 21 penetrating the nozzle plate in a thickness direction is formed. The nozzle plate 20 is disposed so as to face to cover the opening in the second direction of the groove row 14A on one end side of the actuator base 10. The nozzles 21 are provided at positions corresponding to the plurality of pressure chambers C1. That is, the nozzle plate 20 has a nozzle 21 communicating with a pressure chamber C1 formed by a first groove 14*a*, but the nozzle plate 20 covers (closes) the opening of the second groove 14*b*.

The cover plate 30 is formed of, for example, a dry film resist. Specifically, the cover plate 30 is formed using, for example, an epoxy resin-based photoresist as a permanent film (permanent resist). For example, the cover plate 30 has a film thickness of about 40 μm to 50 μm, and is provided on each of both end surfaces of the actuator base 10.

The cover plate 30 is a rectangular plate-like member with an edge portion on the nozzle plate side being formed in a comb teeth shape such that ends (Y-direction) of the first grooves 14*a* are open. In the edge portion of the cover plate 30, a plurality of cutout sections 31 are formed corresponding in position to grooves 14*a*. That is, the cover plate 30 has the plurality of cutout sections 31, and a plurality of cover pieces 32 alternating with the plurality of cutout sections 31. The end surface of the cover piece 32 on the nozzle plate side forms the nozzle facing surface 30*c*. The cutout section 31 is formed to penetrate the cover plate in a thickness direction of the cover plate 30, which is the Y axis direction. The cutout section 31 is disposed at a position corresponding to the first groove 14*a*. Therefore, both ends of each first groove 14*a* in the Y-direction are open inside of the frame section 40*a* and are not covered by a cover plate 30. Therefore, a pressure chamber C1 formed by the first groove 14*a* communicates with the common chamber C3 formed on the outer side of the cover plate 30. Liquid such as ink flows into the pressure chamber C1 through the cutout sections 31.

The cover piece 32 is disposed at a position corresponding to the second groove 14*b*. Therefore, the openings at the both ends of the second groove 14*b* in the Y-direction are closed off by cover pieces 32 of a cover plate 30 and the inflow of the ink is prevented for the second grooves 14*b*.

That is, the pressure chambers C1 communicating with the common chamber C3 and the closed air chambers C2 are alternately formed on one end side of the actuator base 10.

A case member 40 is integrally provided with the frame section 40*a* formed in a rectangular frame shape and a plate-like lid section 40*b* that closes an opening of the frame section 40*a*.

The frame section 40*a* is formed of a ceramic material having aluminum titanate as a main component. The frame section 40*a* surrounds the outer circumference of the actuator base 10 and covers the outer circumference of a part of the region of the actuator base 10. Specifically, the frame section 40*a* includes a pair of plate-like first frame pieces 41 joined to the end surface of the actuator base 10 in the first direction, and a pair of plate-like second frame pieces 42 arranged apart from each other by a predetermined distance on both the principal surfaces 10*a* and 10*b*, which are the outer surface of the actuator base 10.

The frame section 40*a* forms the common chamber C3 between the frame section 40*a* and the actuator base 10 covered by the cover plate 30. The common chamber C3 is formed on the inner side of the frame section 40*a* and the lid section 40*b* and communicates with the pressure chambers C1 through the cutout sections 31 of the cover plate 30.

The laminated piezoelectric body 13 extending in the first direction is disposed at the center of the common chamber C3 in the second direction. The frame section 40*a* plays a guide function for guiding liquid such as ink. An end surface, which is an opening edge, on one side of the frame section 40*a* on the upper side in FIG. 1 forms a nozzle facing surface 40*c* disposed so as to face the nozzle plate 20.

The nozzle facing surface 40*c* forms a flat plane along the XY plane. The nozzle facing surface 40*c* is flush with the nozzle facing surface 10*c* of the actuator base 10 and joined to the outer circumference of the nozzle plate 20. The lid section 40*b* is provided at an end edge, which is an opening edge, on the other side (the side opposite of the nozzle plate 20) of the frame section 40*a* on the lower side in FIG. 1.

The lid section 40*b* is formed integrally with the frame section 40*a*. The lid section 40*b* is formed of, for example, a ceramic material having aluminum titanate, which is the same material as the frame section 40*a*, as a main component. The lid section 40*b* is a rectangular plate-like member having a supply port for causing ink to flow into the common chamber C3 from the outside and a discharge port for discharging the ink to the outside from the common chamber C3. A supply channel 133*a* is connected to the supply port and a collection channel 133*b* is connected to the discharge port. The lid section 40*b* closes one side of the opening of the frame section 40*a* to form the common chamber C3.

An actuator portion, which is a portion on the nozzle plate 20 side of the actuator base 10, is covered by the nozzle plate 20, the frame section 40*a*, and the lid section 40*b*. Various electronic components such as a driving circuit are mounted on the wiring patterns 17 in a portion extending to the outer side of the frame section 40*a* and the lid section 40*b* on the opposite side of the nozzle plate 20 in the actuator base 10.

The plurality of pressure chambers C1 communicating with the nozzles 21, the plurality of air chambers C2 closed by the cover plate 30, and the common chamber C3 communicating with the plurality of pressure chambers C1 are formed on the inside of the frame section 40*a* of the inkjet head 1 configured as described above. The inkjet head 1 circulates the ink in a channel passing through the pressure chambers C1 and the common chamber C3 formed on the inside.

A method of manufacturing an inkjet head 1 according to the present embodiment will be described with reference to FIG. 5. The method of manufacturing the inkjet head 1 according to the present embodiment includes injection-molding a ceramic material having aluminum titanate as a main component to form a frame section 40*a*, and polishing an actuator base 10 that is formed of a piezoelectric ceramic material and has a plurality of grooves, and the frame section 40*a* to form polished surfaces 50*c* to be joined to the nozzle plate 20.

Specifically, an actuator base 10 without grooves 14 is formed first. For example, two plate-like piezoelectric members polarized in the plate thickness direction are laminated so that the polarization directions thereof are different, and the laminate is cut into a desired width and a desired length to form a laminated piezoelectric body 13.

Further, the laminated piezoelectric body 13 is attached to a plate-like substrate 12 formed of a material different from that of the piezoelectric member constituting the laminated piezoelectric body 13 with an adhesive or the like, and machined using a dicing saw or a slicer to form an actuator base 10 having a predetermined outer shape. For example, a block-like base member having a thickness of a plurality of sheets may be formed in advance and then separated to manufacture a plurality of actuator bases 10 having a predetermined shape.

Subsequently, as ACT 1, the first grooves 14*a* and the second grooves 14*b* are formed in the laminated piezoelectric body 13 of the actuator base 10 by machining. Further, conductive films such as the electrodes 16 and the wiring patterns 17 are formed at predetermined locations on the outer surface of the actuator base 10 including the inside of each of the grooves 14*a* and 14*b* by a vacuum deposition method or the like.

Subsequently, as ACT 2, a plate-like dry film resist 30A which becomes the cover plate 30 is attached to both surfaces of the actuator base 10. Specifically, for example, the plate-like dry film resist 30A is pressed against the both end surfaces of the actuator base 10 in the second direction and is thermally compressed by a heated roller at around 50° C.

Subsequently, as ACT 3, an exposure treatment is performed. Specifically, first, for example, a photomask having a negative pattern shape is disposed on the end surface of the actuator base 10 in an overlapped manner, and a prebaking treatment is performed at around 90° C. using the photomask. Thus, a predetermined portion not covered by the photomask of the dry film resist 30A is temporarily cured. Further, by immersing the dry film resist 30A in a special developer, the predetermined portion corresponding to the pattern shape of the photomask is dissolved to form openings which become the cutout sections 31. Further, by performing a post baking treatment at around 120° C., the dry film resist 30A is fully cured. By the above exposure and development, the dry film resist 30A is formed into a predetermined shape in which the plurality of cutout sections 31 and the convex cover pieces 32 are alternately arranged. For example, in the present embodiment, the cutout sections 31 are disposed at positions facing the first grooves 14*a* and the second grooves 14*b* are covered by the cover pieces 32.

Further, as ACT 4, the frame section 40*a* is disposed on the outer side of the cover plate 30 and the lid section 40*b* is disposed so as to cover the common chamber C3. The frame section 40*a* and the lid section 40*b* are assembled and joined by fixing to form a case member 40.

Next, as ACT 5, in a state in which the cover plate 30 and the case member 40 are joined to the actuator base 10, the nozzle facing surfaces 10*c*, 30*c*, and 40*c* of the actuator base 10, the cover plate 30, and the frame section 40*a* are polished to form flush polished surfaces 50*c*. At this time, since the frame section 40*a* has working properties close to those of the actuator base 10 in terms of workability, polishing can be performed at the same time and the nozzle facing surfaces 10*c*, 30*c*, and 40*c* of the actuator base 10, the cover plate 30, and the frame section 40*a* can be polished with high accuracy.

The nozzle plate 20 is attached by bonding so as to cover the grooves 14*a* and 14*b*. At this time, the nozzle plate 20 is attached so nozzles 21 are disposed so as to face the first grooves 14*a* and the second grooves 14*b*. Further, as shown in FIG. 1, the inkjet head 1 is completed by connecting a driving IC chip 52 and a circuit board 53 to the wiring pattern 17 formed on the principal surface of the substrate 12 through a flexible cable 51.

Figure 6:
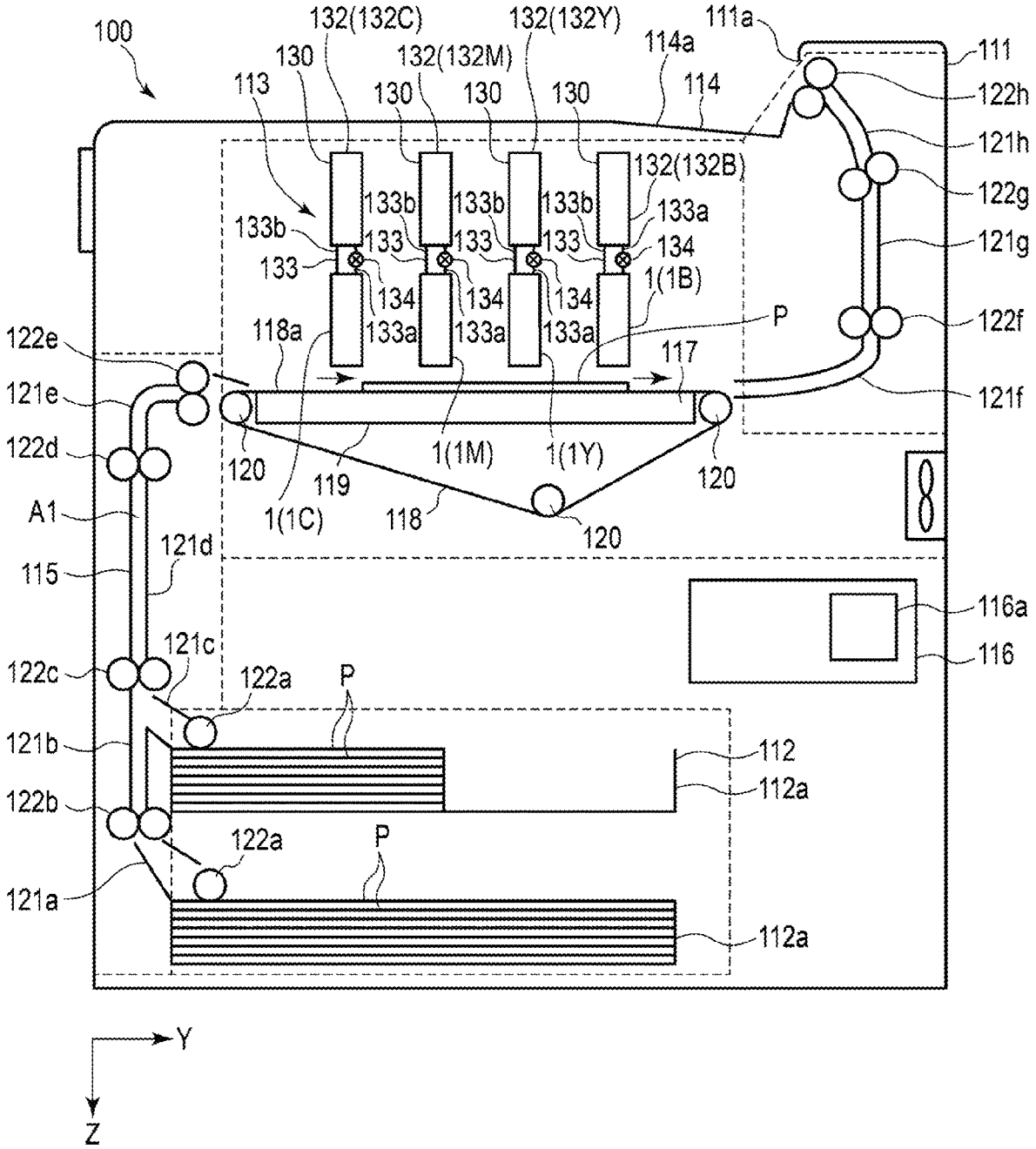
FIG. 6 illustrates a configuration of an inkjet printer using the inkjet head.

FIG. 6 is an explanatory diagram illustrating the configuration of the inkjet printer 100. As shown in FIG. 6, the inkjet printer 100 includes a housing 111, a (recording) medium supplying section 112, an image forming section 113, a (recording) medium discharging section 114, a conveying device 115, and a control section 116.

The inkjet printer 100 is an example of a liquid discharge apparatus that discharges liquid, in this case ink, while conveying paper P, which is an example of a recording medium and a discharge target object, along a predetermined conveyance path A1 leading from the medium supplying section 112 to the medium discharging section 114 through the image forming section 113 to perform image formation processing on the paper P.

The medium supplying section 112 includes a plurality of paper feeding cassettes 112*a*. The medium discharging section 114 includes a paper discharge tray 114*a*. The image forming section 113 includes a supporting section 117 that supports paper and a plurality of head units 130 disposed above the supporting section 117 so as to face the supporting section 117.

The supporting section 117 includes a conveyance belt 118 provided in a loop shape in a predetermined region where image formation can be performed, a support plate 119 that supports the conveyance belt 118 from the rear side, and a plurality of belt rollers 120 provided on the rear side of the conveyance belt 118.

The head units 130 include a plurality of inkjet heads 1, a plurality of ink tanks 132 mounted on the inkjet heads 1, connection channels 133 that connect the inkjet heads 1 to the ink tanks 132, and circulation pumps 134, which are circulating sections. The head units 130 are circulation-type head units that circulate liquid.

In the present embodiment, the inkjet printer 100 includes the inkjet heads 1C, 1M, 1Y, and 1B of four colors of cyan, magenta, yellow, and black and includes ink tanks 132C, 132M, 132Y, and 132B as that respectively contain inks of these colors. The ink tanks 132 are connected to the inkjet heads 1 by the connection channels 133 (see FIG. 6). The connection channels 133 each include a supply channel 133*a* connected to a supply port of the inkjet heads 1 and a collection channel 133*b* connected to a discharge port of the inkjet heads 1.

Negative-pressure control devices, such as pumps, are coupled to the ink tanks 132. Negative pressure control is performed in the ink tanks 132 by the negative-pressure control devices according to hydrostatic head values in the inkjet heads 1 and the ink tanks 132 to form ink (liquid) meniscuses having a predetermined shape at the nozzles of the inkjet heads 1.

The circulation pumps 134 are, for example, liquid feeding pumps such as piezoelectric pumps. The circulation pumps 134 are provided in the supply channels 133*a*. The circulation pumps 134 are connected to a driving circuit of the control section 116 by wires. A central processing unit (CPU) 116*a* is configured to control the circulation pumps 134. The circulation pumps 134 circulate liquid in the circulation channels including the inkjet heads 1 and the ink tanks 132.

The conveying device 115 conveys the paper P along the conveyance path A1 leading from the paper feeding cassettes 112*a* of the medium supplying section 112 to the paper discharge tray 114*a* of the medium discharging section 114 through the image forming section 113. The conveying device 115 includes a plurality of guide plate pairs 121*a* to 121*h* and a plurality of conveyance rollers 122*a* to 122*h* arranged along the conveyance path A1.

The control section 116 includes the CPU 116*a*, which is a controller, a read only memory (ROM) that stores various programs and the like, a random access memory (RAM) that temporarily stores various variable data, image data, and the like, and an interface section for inputting data from the outside and outputting data to the outside.

In the inkjet head 1 and the inkjet printer 100, the control section 116 applies, with the driving circuit, a driving voltage via the wiring patterns 17 when liquid is discharged from the nozzles 21. When a potential difference is applied to an electrode in the pressure chamber C1 to be driven by the application of the voltage and electrodes in the air chambers C2 on both sides of the pressure chamber C1, the first piezoelectric elements 15*a* and the second piezoelectric elements 15*b* are deformed in directions opposite to each other. Driving elements are bent and deformed by the deformation of both the piezoelectric elements. For example, as shown in FIG. 3, the pressure chamber C1 to be driven is first deformed in an opening direction and a negative pressure is generated in the pressure chamber C1 to guide ink from the cutout sections 31 into the pressure chamber C1. Subsequently, as shown in FIG. 4, the pressure chamber C1 is deformed in a closing direction and the inside of the pressure chamber C1 is pressurized to discharge ink droplets from the nozzles 21.

In the inkjet head 1 and the inkjet printer 100 according to the present embodiment, since the frame section 40*a* is formed of a material including aluminum titanate, the frame section can be polished together with the actuator base 10, and the inkjet head 1 can be more easily and inexpensively manufactured. A free-cutting ceramic is generally an expensive material and cannot be used f injection molding or the like, and the shape thereof is required to be formed by a cutting process, the inkjet head 1 is thus very expensive. Furthermore, since a moldable ceramic such as alumina has a hardness that is substantially different from that of PZT, the processing conditions are inherently and greatly different from each other. Thus when used as a frame, there may be a step height difference in the nozzle facing surface facing the nozzle plate 20, or a large amount of chippings can be generated in the PZT. Thus, when the nozzle plate 20 is bonded, gaps may be left, which causes ink leakage. In contrast, in the present embodiment, since the piezoelectric ceramic constituting the actuator base 10 and the aluminum titanate constituting the frame section 40*a* can be processed under the same processing conditions, the flush polished surfaces 50*c* can be formed by simultaneous polishing, and a gap can be prevented from being left when the nozzle plate 20 is bonded. In addition, since the cover plate 30 is very thin, there is little influence on the bonded surface. In addition, since the frame section is formed of aluminum titanate that can be injection-molded, processing can be performed at a low cost. Accordingly, the inkjet head 1 can be manufactured at a low cost by molding methods and then simultaneous polishing. Furthermore, since the processing accuracy of the nozzle facing surface can be improved, the sealability between the pressure chamber C1 and the common chamber C3 can be improved, and the liquid discharge performance can be improved for the inkjet head 1 according to the embodiment(s).

The possible embodiments are not limited to the above example embodiment details, and can be embodied by modifying the various components and/or elements without departing from the spirit of the present disclosure.

In the present embodiment, the inkjet head 1 of the so-called end shooter type was explained, but the present disclosure is not limited thereto. For example, the present disclosure may be applied to an inkjet head of a side shooter type. For example, a predetermined direction different from a surface facing a nozzle plate in a comb teeth-like actuator base with grooves open in two different directions may be closed by a plate-like member as a first member. In this case, the plate-like member is formed by molding ceramic material having aluminum titanate as a main component. Even in the present embodiment, by polishing the actuator base and the plate-like member at the same time to form flush polished surfaces, and joining the nozzle plate to the polished surfaces, the pressure chamber can be more easily formed at a low cost with high accuracy.

In the above embodiment, an example in which the actuator base 10 has the grooves 14*a* and 14*b* reaching to both ends in the second direction and the cover plate 30 is provided on both sides is shown, but the embodiments are not limited thereto. For example, the actuator base may have a configuration in which the first grooves 14*a* and the second grooves 14*b* are open on one side of the actuator base 10 and the cover plate 30 is disposed only on one side of the actuator base 10. Also in this case, the same effect as that of the above example embodiment can be obtained. A shape in which the frame section 40*a* surrounds the periphery of the end portion in which the grooves 14 are formed in the actuator base 10 is exemplified, but the present disclosure is not limited thereto.

An example in which the cover plate 30 was formed of a dry film resist and formed in a predetermined shape by exposure was explained, but the present disclosure is not limited thereto. For example, using the cover plate formed in a plate-like shape, the nozzle facing surface of the cover plate facing the nozzles may be polished together with the actuator base 10 and the frame section 40*a*.

In the example embodiment, the actuator base 10 including the laminated piezoelectric body 13 formed of a piezoelectric member on the substrate 12 was exemplified, but the present disclosure is not limited thereto. For example, the actuator base 10 may be formed using only a piezoelectric member without using the substrate 12. In addition, instead of using two piezoelectric members, one piezoelectric member may be used.

According to at least one embodiment described above, it is possible to provide an inkjet head and an inkjet device that are easily manufactured.

The liquid to be discharged is not limited to printing ink, but may be, for example, a liquid containing conductive particles for forming a wiring pattern of a printed wiring board.

In the example embodiment, the inkjet head is used for a liquid discharge apparatus such as an inkjet recording apparatus (printer) was explained, but the present disclosure is not limited thereto. For example, the inkjet head can be applied to a 3D printer, an industrial manufacturing machine, or a medical device, and miniaturization, light weight, and cost reduction can be achieved in such devices as well.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid discharge head, comprising:

an actuator base of a piezoelectric ceramic material and including a plurality of first grooves spaced from each other in a first direction and extending in a second direction;

a case member including a frame portion spaced from the actuator base in the second direction, the frame portion having an end surface that is level with an end surface of the actuator base in a third direction orthogonal to the first and second directions, the frame portion being formed of a ceramic material having aluminum titanate as a main component;

a nozzle plate contacting the end surface of the frame portion and the end surface of the actuator base; and a cover plate coupled to a side surface of the actuator base, the cover plate having a plurality of recesses corresponding in position with the plurality of first grooves.

2. The liquid discharge head according to claim 1, wherein a common chamber that communicates with the plurality of first grooves is between the frame portion and the actuator base.

3. The liquid discharge head according to claim 2, wherein the actuator base further includes a plurality of second grooves between the plurality of first grooves in the first direction, each of the second grooves extending in the second direction, but closed off from the common chamber by the cover plate.

4. The liquid discharge head according to claim 1, wherein an end surface of the cover plate contacts the nozzle plate and is level with the end surface of the actuator base and the end surface of the frame portion in the third direction.

5. The liquid discharge head according to claim 1, wherein the cover plate comprises a resin material.

6. The liquid discharge head according to claim 1, wherein the nozzle plate includes a plurality of nozzles corresponding in position to the plurality of first grooves.

7. The liquid discharge head according to claim 1, wherein an end of the cover plate is flush with the end surface of the actuator base in the third direction, the actuator base has a plurality of second grooves between the plurality of first grooves in the first direction and extending in parallel with the first grooves along the second direction, and the cover plate covers ends of the plurality of first grooves in the second direction, but not ends of the plurality of second grooves in the second direction.

8. The liquid discharge head according to claim 7, wherein the cover plate comprises a resin material.

9. The liquid discharge head according to claim 1, wherein the cover plate is a first cover plate coupled to a first side surface of the actuator base in the second direction, and the liquid discharge head further comprises a second cover plate coupled to a second side surface of the actuator base opposite of first side surface, the second cover plate having a plurality of recesses corresponding in position to the plurality of first grooves.

10. The liquid discharge head according to claim 9, wherein a surface of the first cover plate contacting the nozzle plate and a surface of the second cover plate contacting the nozzle plate are both flush with the end surface of the actuator base.

11. The liquid discharge head according to claim 1, further comprising:

electrodes in the plurality of first grooves.

12. A printer, comprising:

a media conveyer; and a liquid discharge head configured to form an image on a medium conveyed by the media conveyer, the liquid discharge head comprising:

an actuator base of a piezoelectric ceramic material and including a plurality of first grooves spaced from each other in a first direction and extending in a second direction;

a case member including a frame portion spaced from the actuator base in the second direction, the frame portion having an end surface that is level with an end surface of the actuator base in a third direction orthogonal to the first and second direction, the frame portion being formed of a ceramic material having aluminum titanate as a main component;

a nozzle plate contacting the end surface of the frame portion and the end surface of the actuator base; and a cover plate coupled to a side surface of the actuator base, the cover plate having a plurality of recesses corresponding in position to the plurality of first grooves.

13. The printer according to claim 12, wherein a common chamber that communicates with the plurality of first grooves is between the frame portion and the actuator base.

14. The printer according to claim 13, wherein the actuator base further includes a plurality of second grooves between the plurality of first grooves in the first direction, each of the second grooves extending in the second direction, but closed off from the common chamber by the cover plate.

15. The printer according to claim 12, wherein an end surface of the cover plate contacts the nozzle plate and is level with the end surface of the actuator base and the end surface of the frame portion in the third direction.

16. The printer according to claim 12, wherein the cover plate comprises a resin material.

17. A method for manufacturing a liquid discharge head, comprising:

forming an actuator base including a plurality of first grooves spaced from each other in a first direction, each of the first grooves extending in a second direction, the actuator base being a piezoelectric ceramic material;

forming a case member including a frame portion of a ceramic material having aluminum titanate as a main component;

simultaneously grinding an end surface of the frame portion in a third direction that is orthogonal to the first and second directions and an end surface of the actuator base in the third direction so the end surface of the frame portion is level with the end surface of the actuator base; and coupling a nozzle plate to the end surface of the frame portion and the end surface of the actuator base.

18. The method according to claim 17, further comprising:

disposing a cover plate on a side surface of the actuator base, the cover plate being a resin material, wherein an end surface of the cover plate is ground at the same time as the end surface of the actuator base.

19. The method according to claim 18, further comprising:

forming, in the cover plate, a plurality of recesses corresponding in position with the plurality of first grooves.

20. The method according to claim 18, wherein said grinding is carried out after the plurality of recesses are formed.

* * * * *